US006977332B2

(12) United States Patent
Liao

(10) Patent No.: US 6,977,332 B2
(45) Date of Patent: Dec. 20, 2005

(54) ANCHORING STRUCTURE FOR TELESCOPIC TUBES OF DRUM SETS

(76) Inventor: Tsun-Chi Liao, 1F, No. 7, Lane 545, Sec. 2, Chun-Kung Rd., Taichung City (TW)

( * ) Notice: Subject to any disclaimer, the term of this patent is extended or adjusted under 35 U.S.C. 154(b) by 70 days.

(21) Appl. No.: 10/803,974

(22) Filed: Mar. 19, 2004

(65) Prior Publication Data

US 2005/0204896 A1 Sep. 22, 2005

(51) Int. Cl.[7] ..... G10D 13/02

(52) U.S. Cl. ..... 84/421; 84/329

(58) Field of Search ..... 84/327, 421, 329; 248/442

(56) References Cited

U.S. PATENT DOCUMENTS

| | | | | |
|---|---|---|---|---|
| 4,252,047 A * | 2/1981 | Gauger | | 84/421 |
| 4,519,289 A * | 5/1985 | Gauger | | 84/421 |
| D337,345 S * | 7/1993 | Gracie | | D17/99 |
| 6,693,234 B2 * | 2/2004 | Smith | | 84/327 |

* cited by examiner

*Primary Examiner*—Kimberly Lockett
(74) *Attorney, Agent, or Firm*—Birch, Stewart, Kolasch & Birch, LLP

(57) ABSTRACT

A telescopic tube includes an inner tube and an outer tube. A fixing lock is provided that includes a fixing hub and a movable arm to couple with the perimeter of the outer tube. The fixing hub and the movable arm have respectively an arched trough on a corresponding surface in the center to clamp the inner tube. The fixing hub has a collar to couple with the inner tube. A drum may be steadily mounted and anchored on the telescopic tube. The telescopic tube may also be adjusted with a greater steadiness without shaking.

9 Claims, 9 Drawing Sheets

ANCHORING STRUCTURE FOR TELESCOPIC TUBES OF DRUM SETS

FIELD OF THE INVENTION

The present invention relates to an anchoring structure for drum sets and particularly to an anchoring structure for adjusting and setting the height of drum sets.

BACKGROUND OF THE INVENTION

Referring to FIGS. 1 and 2, the anchoring structure for a conventional drum 1 usually includes a rotary dock 2 located respectively on two sides to couple with a telescopic tube 3 for standing on the floor. The telescopic tube 3 has an inner tube 4 and an outer tube 5. A bolt 6 runs through the outer tube 5 to press the inner tube 4 to set the telescopic tube at a desired length. Users may unfasten and fasten the bolt 6 to adjust the length of the telescopic tube 3.

The conventional technique for setting the telescopic tube 3 mentioned above relies on one bolt 6 to press the inner tube 4. The compression area is small and is prone to loose. When the drum 1 is struck for a long period of time and shock occurs constantly, the inner tube 4 is easily deformed and the telescopic tube 3 is prone to shaking. The sound generated by the drum 1 is affected.

FIG. 3 illustrates another conventional anchoring structure. It includes a telescopic tube 3 which consists of an inner tube 4 and an outer tube 5, and a fixing hub 7 and a movable arm 8 coupled with a movable joint 7A so that they may be opened or closed like clam shells. The fixing hub 7 is coupled on the outer tube 5 and fastened by a fastening element 9. The movable arm 8 and the inner tube 4 form a large contact area to make fastening more steady. However, in such a structure the inner tube 4 does not have any support while the fastening element 9 is unfastened, and the inner tube 4 often tilts abruptly. As the drum 1 (referring to FIG. 1) supported by the inner tube is quite heavy, the inner tube 4 could be bent and result in adjustment difficulty later. Moreover, the anchoring angle could be inaccurate and the sound generated by the drum 1 could be affected.

SUMMARY OF THE INVENTION

Therefore the primary object of the invention is to provide a telescopic tube that can withstand the shock of the drum, and is more steady and less likely to be damaged when the length of the telescopic tube is adjusted.

The telescopic tube according to the invention includes an inner tube and an outer tube that are coupled together. The telescopic tube has one side coupled to a rotary dock to fasten to a drum. Another side of the telescopic tube stands on the floor. It also has a fixing lock that consists of a fixing hub and a movable arm. The fixing hub is coupled on the perimeter of one end of the outer tube and is coupled with the movable arm through a movable joint. The fixing hub and the movable arm have respectively an arched trough on a surface in the center corresponding to each other to be in contact with the inner tube and hold the inner tube. There is a fastening structure located on one side of the fixing hub and the movable arm. The fastening structure is run through by a fastening element for fastening the fixing hub and the movable arm to urge the arched troughs to clamp the inner tube tightly. The fixing hub further has a collar which has a slightly larger diameter than the inner tube to facilitate coupling of the inner tube.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
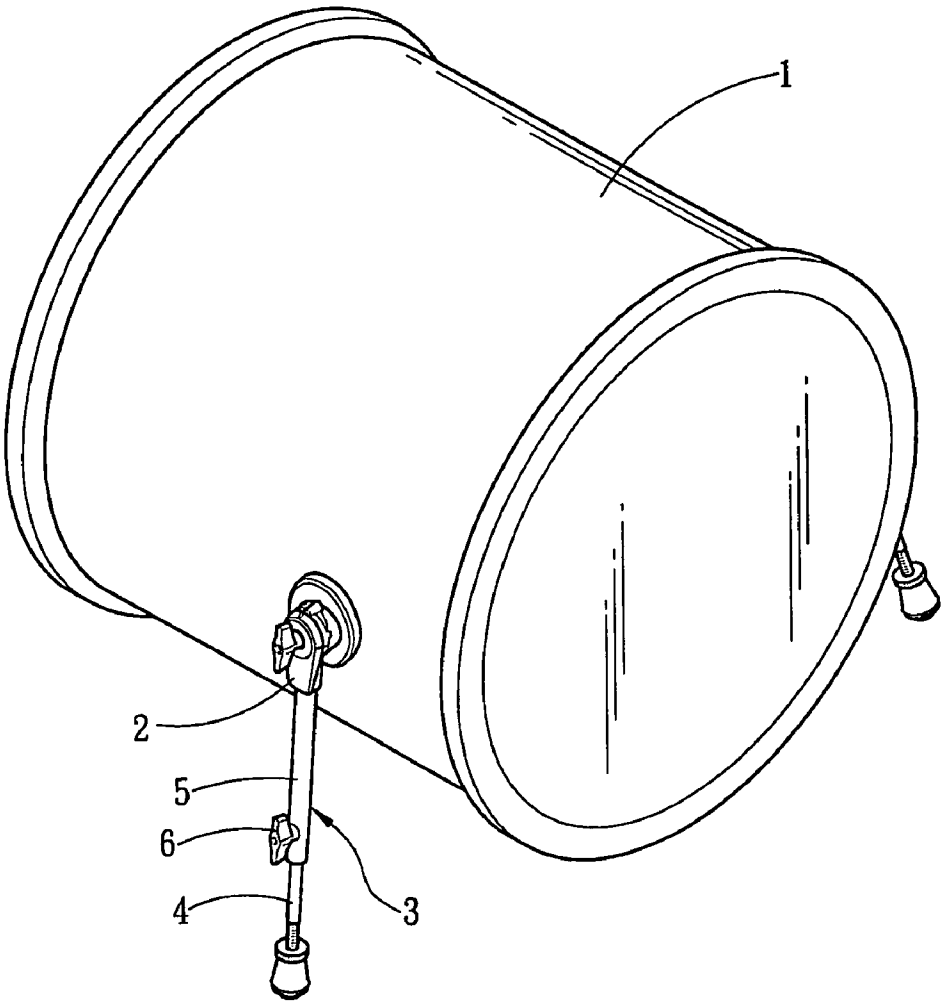
Fig. 1 PRIOR ART
FIG. 1 is a schematic view of an anchoring structure for a conventional telescopic tube of a drum in a use condition.
Figure 2:
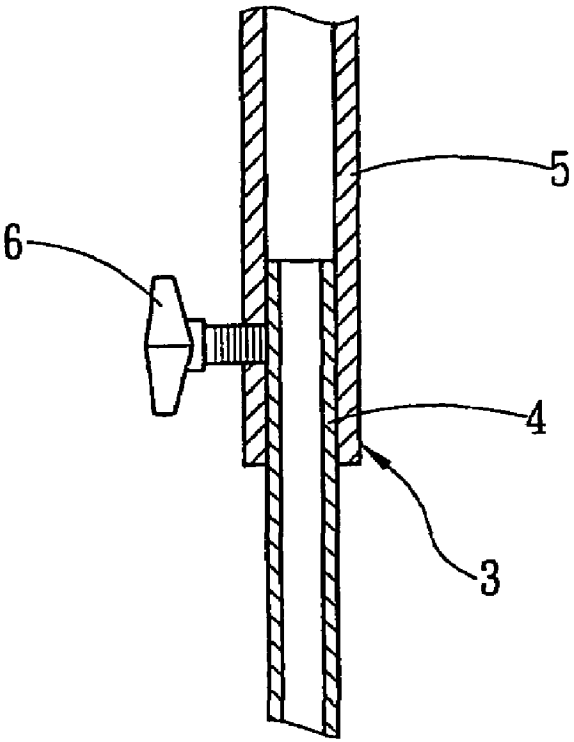
Fig. 2 PRIOR ART
FIG. 2 is a schematic view of an anchoring structure for a conventional telescopic tube.
Figure 3:
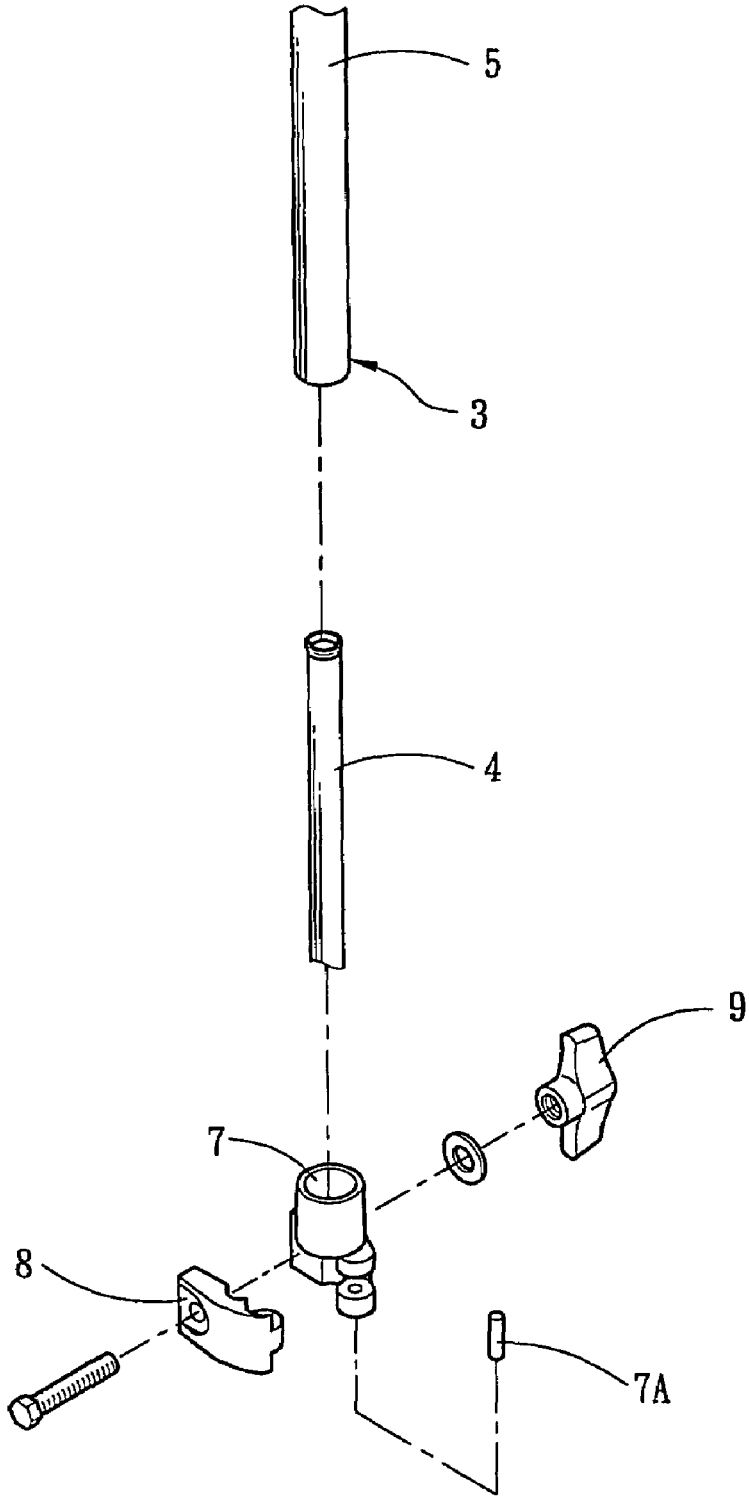
Fig . 3 PRIOR ART
FIG. 3 is a schematic view of another anchoring structure for a conventional telescopic tube.
Figure 4:
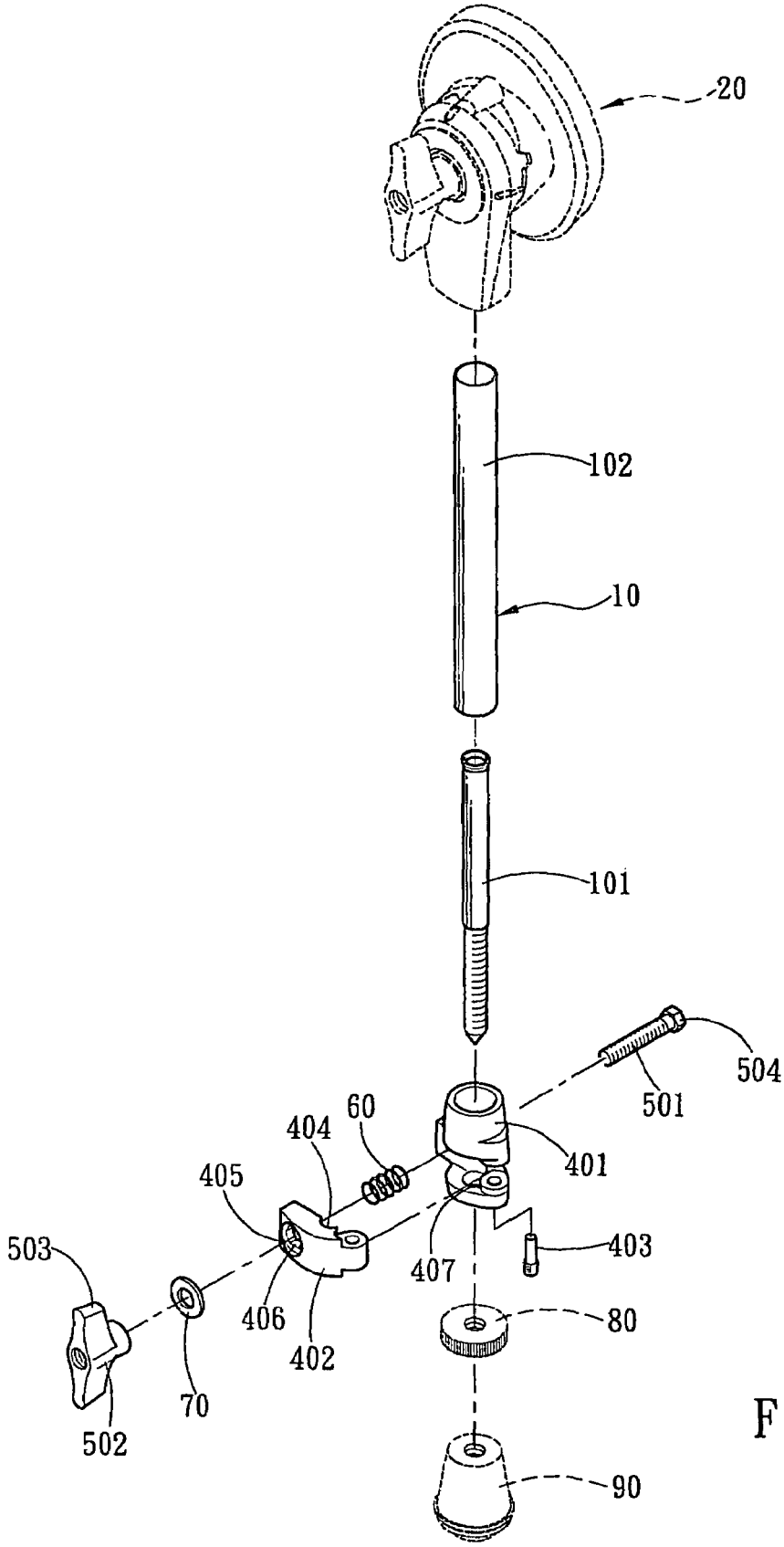
FIG. 4 is an exploded view of the invention.
Figure 5:
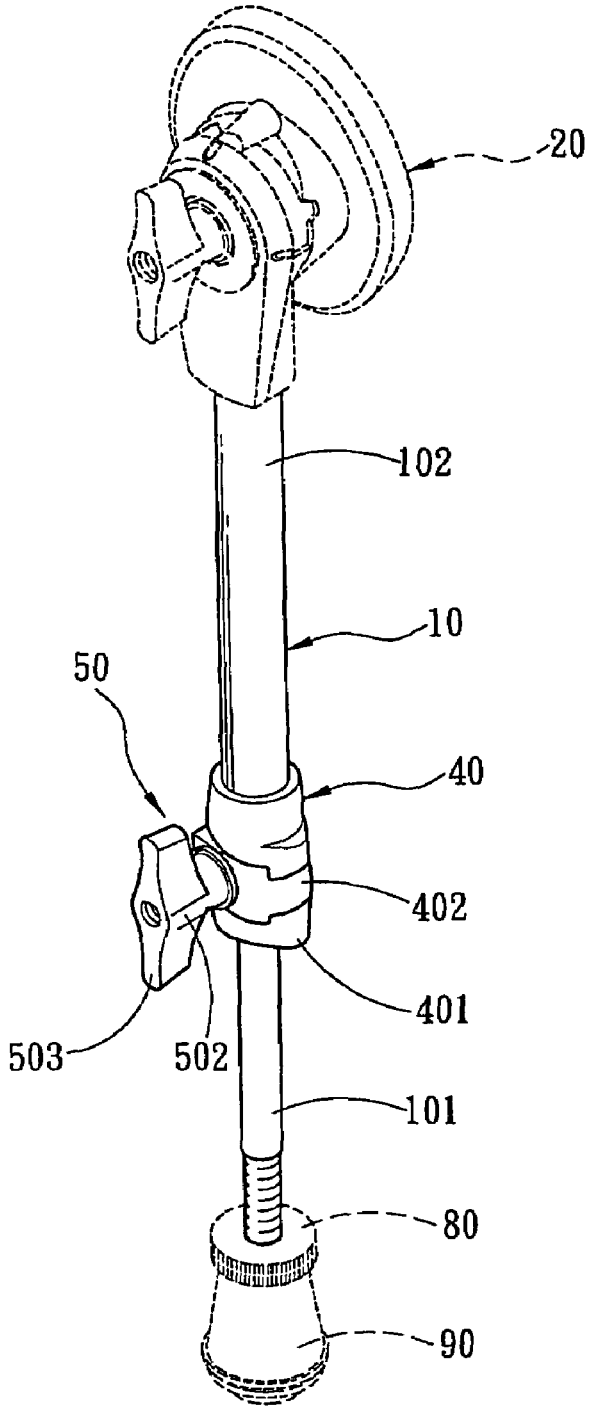
FIG. 5 is a perspective view of the invention in an assembled condition.

Please referring to FIGS. 4 and 5, the invention includes a telescopic tube 10 which consists of an inner tube 101 and an outer tube 102 that are coupled together. The telescopic tube 10 is coupled with a rotary dock 20 on one side to fasten to a drum (not shown in the drawings). The telescopic tube 10 has another side coupled with a buffer pad 90 and an adjustment ring 80 for standing on the floor. A fixing lock 40 is provided that consists of a fixing hub 401 and movable arm 402 that are coupled through a movable joint 403 such that they may be opened or closed like clam shells. The fixing hub 401 is coupled on the perimeter of one end of the outer tube 102. The fixing hub 401 and the movable arm 402 have respectively an arched trough 404 on a corresponding surface in the center to be in contact with the inner tube 101 and holds the inner tube 101. On the movable side of the fixing hub 401 and the movable arm 402, there is a fastening structure 405 (running through the fixing hub 401 and the movable arm 402) run through by a fastening element 50 for fastening the fixing hub 401 and the movable arm 402 so that the arched troughs 404 can clamp the inner tube 101 tightly.

Figure 6:
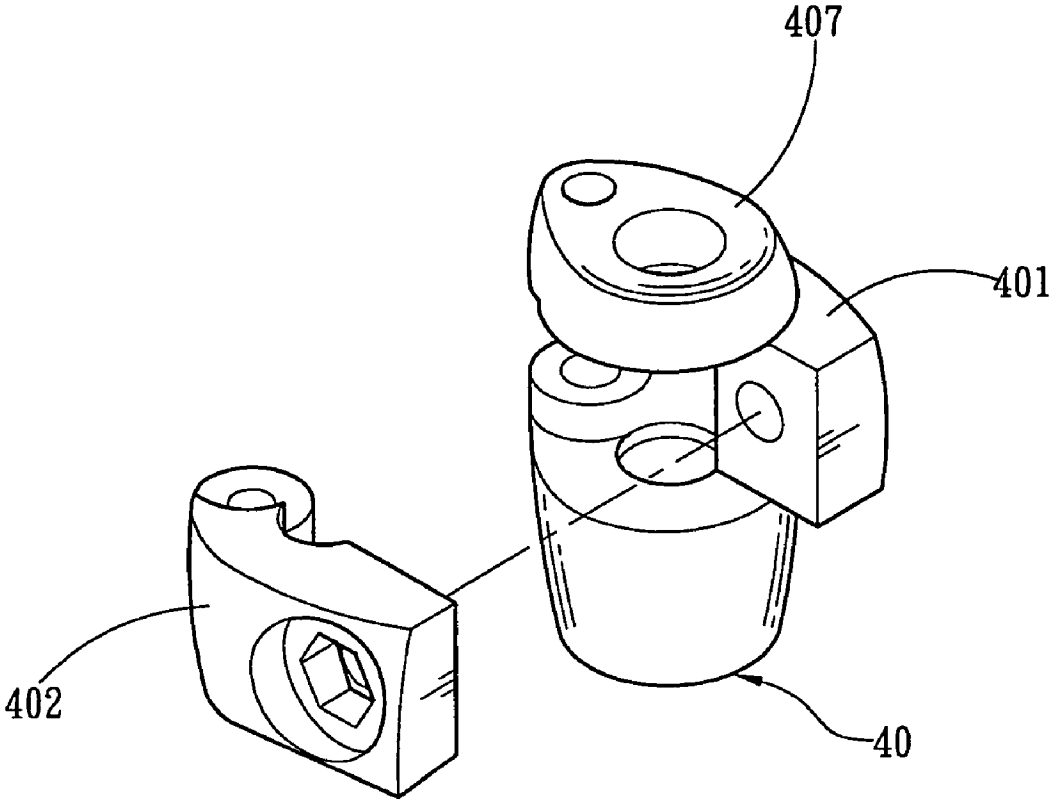
FIG. 6 is a perspective view of the fixing lock of the invention.

The fastening element 50 may be coupled with a spring 60 after having run through the fastening structure 405 so that when the fastening element 50 is unfastened the spring 60 pushes the movable arm 402 away from the fixing hub 401 to facilitate adjustment of the length of the telescopic tube 10. The fastening structure 405 may include through a bore formed respectively on the fixing hub 401 and the movable arm 402. The fastening element 50 may include a bolt 501 and a nut 502. The bolt 501 runs through the fastening structure 405 to couple with the nut 502 to enable the arched troughs 404 to clamp the inner tube 101 thereby to adjust the length of the telescopic tube 10. A washer 70 may be added between the fixing lock 40 and the nut 502 to make screw fastening more steadily. The nut 502 may also have a hand-gripping wing 503 extended respectively towards two sides to facilitate user fastening and unfastening of the nut 502 with hands. The bores on the fastening structure 405 (running through the fixing hub 401 and the movable arm 402) on the left side and the right side have respectively a latch trough 406 with a size matching the bolt head 504 of the bolt 501 but larger than the bore diameter so that the bolt head 504 of the bolt 501 may be latched in the latch trough 406 to facilitate turning of the nut 502. Refer to FIG. 6 for a view from another angle of the fixing lock 40. The fixing hub 401 has a collar 407 which has the diameter slightly greater than the inner tube 101 for coupling the inner tube 101.

Figure 7:
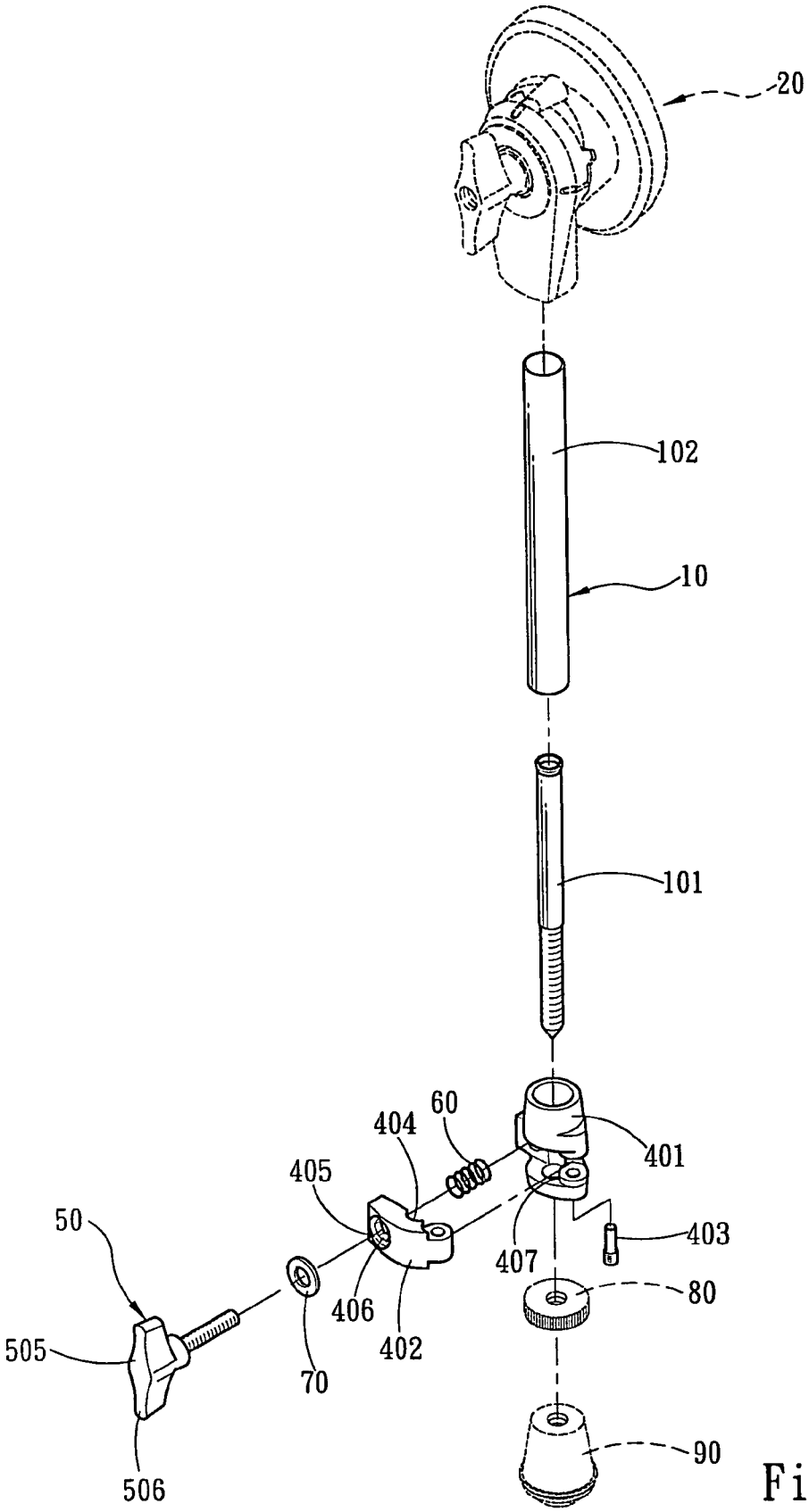
FIG. 7 is a schematic view of another embodiment of the anchoring structure of the invention.

Referring to FIG. 7, the bore of the fastening structure 405 on the fixing hub 401 may be replaced by a screw hole, and the fastening element 50 may be a screw 505. Then the screw 505 may run through the fixing hub 401 and the movable arm 402 to be coupled with the screw hole to urge the arched troughs 404 to clamp the inner tube 101. The top end of the screw 505 may be extended to the left side and the right side to form a hand-gripping wing 506 to facilitate user fastening and unfastening of the screw 505 with hands. A washer 70 may be added between the fixing lock 40 and the screw 505 to make screw fastening more steadily.

Figure 8:
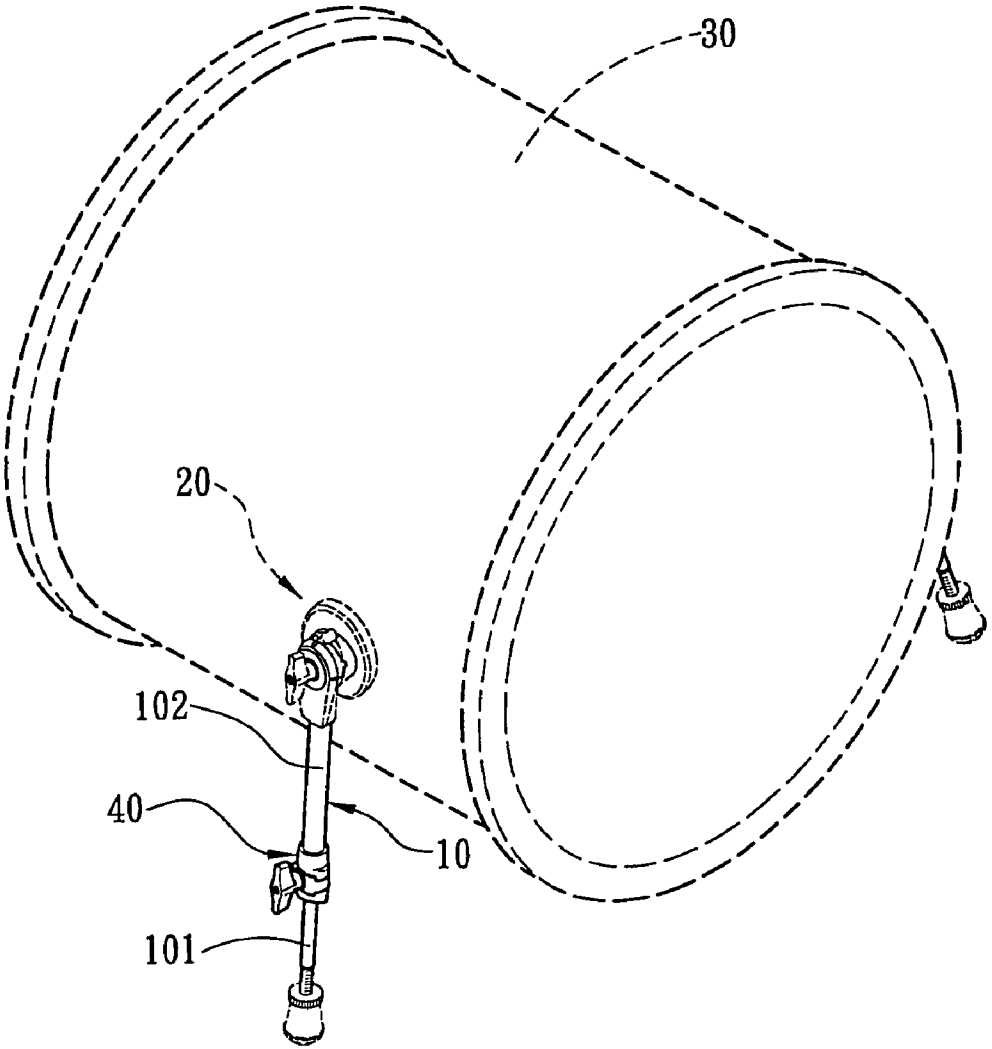
FIG. 8 is a schematic view of the invention in a use condition.
Figure 9:
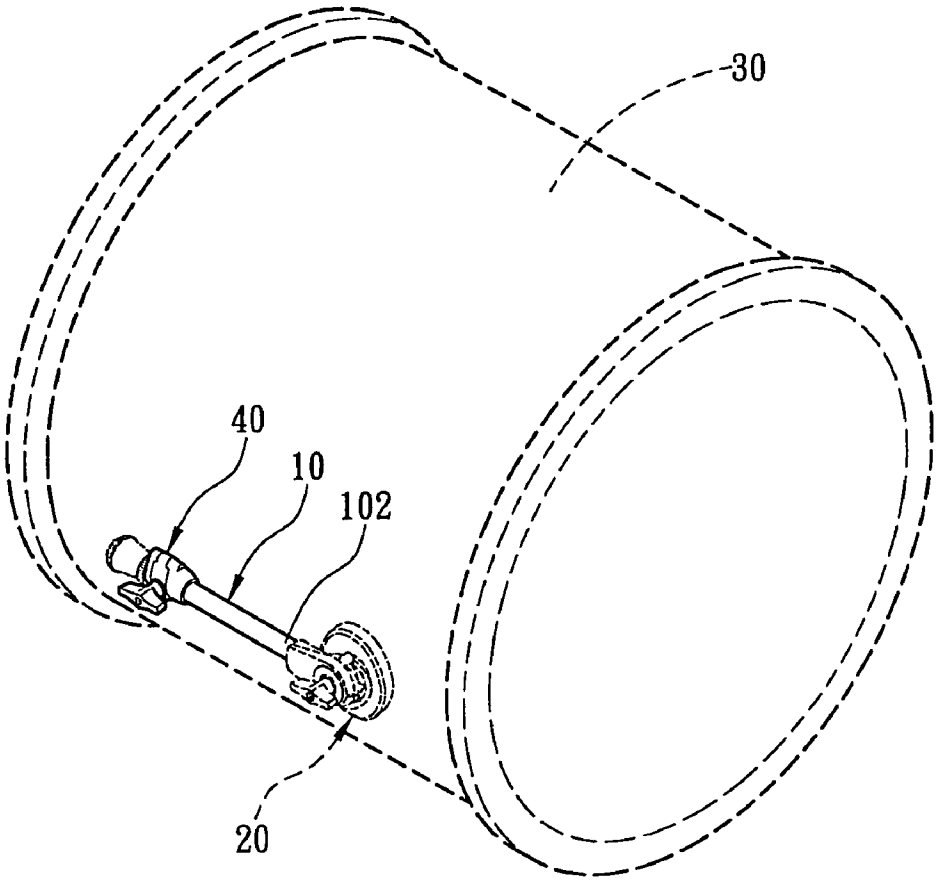
FIG. 9 is a schematic view of the invention in another use condition.

Referring to FIGS. 8 and 9, the telescopic tube 10 is fastened to each of two sides of a drum 30 through the rotary dock 20. For storing the drum 30, the telescopic tube 10 may be moved to one side of the drum 30 to save space. When in use, the telescopic tube 10 may be turned to a desired angle through the rotary dock 20, and the fixing lock 40 may be unfastened, and the telescopic tube 10 is adjusted at a desired length and then being fastened tightly for standing on the floor for use. As the telescopic tube 10 is anchored by clamping the inner tube 101 with the entire surface of the arched troughs 404 (as shown in FIG. 7), the anchoring surface is greater and anchoring is steadier than the conventional approaches. It also is less likely to damage the inner tube 101 and does not affect the coupling of the inner tube 101 and the outer tube 102. Therefore it is less likely to affect the sound generation of the drum 30. The collar 407 (as shown in FIG. 7) can prevent the inner tube 101 from tilting relative to the outer tube 102 when the fastening element 50 is unfastened to adjust the length of the telescopic tube 10, thus the inner tube 101 may be prevented from bending to increase the steadiness of the telescopic tube 10 avoid damaging the telescopic tube 10.

What is claimed is:

1. An anchoring structure for telescopic tubes of drum sets to adjust the height of a drum, comprising:

a telescopic tube including an inner tube and an outer tube that are coupled together, the telescopic tube having one side coupled with a rotary dock to fasten the drum and another side standing on a floor; and a fixing lock including a fixing hub and a movable arm coupled through a movable joint, the fixing hub having a collar and being anchored on the perimeter of one end of the outer tube, the collar having a diameter greater than the diameter of the inner tube for coupling with the inner tube, the fixing hub and the movable arm having respectively an arched trough on a corresponding surface in the center thereof to be in contact with the inner tube and for holding the inner tube, and having a movable side formed a fastening structure which is run through by a fastening element for fastening the fixing hub and the movable arm to urge the arched troughs to clamp the inner tube.

2. The anchoring structure for telescopic tubes of drum sets of claim 1, wherein the fastening element is coupled with a spring.

3. The anchoring structure for telescopic tubes of drum sets of claim 1, wherein the fastening structure includes bores, and the fastening element is an assembly of a bolt and a nut.

4. The anchoring structure for telescopic tubes of drum sets of claim 3, wherein the nut is extended to form a hand-gripping wing.

5. The anchoring structure for telescopic tubes of drum sets of claim 3, wherein the fastening structure has a latch trough in the bores matching the size of a bolt head of the bolt.

6. The anchoring structure for telescopic tubes of drum sets of claim 3, further having a washer between the fixing lock and the nut.

7. The anchoring structure for telescopic tubes of drum sets of claim 1, wherein the fastening structure on the fixing hub is a screw hole, and the fastening element is a screw.

8. The anchoring structure for telescopic tubes of drum sets of claim 7, wherein the top end of the screw is extended to form a hand-gripping wing.

9. The anchoring structure for telescopic tubes of drum sets of claim 7, further having a washer between the fixing lock and the screw.

* * * * *